United States Patent [19]

Massucci et al.

[11] 4,154,181

[45] May 15, 1979

[54] METHOD OF MARKING-OUT PATTERNS ON CLOTH FOR SEWING

[76] Inventors: Josephine V. Massucci, 2725 Beechwood Blvd., Pittsburgh, Pa. 15217; Rosemary A. Parlak, 7116 McClure Ave., Pittsburgh, Pa. 15218

[21] Appl. No.: 844,641

[22] Filed: Oct. 25, 1977

Related U.S. Application Data

[62] Division of Ser. No. 730,469, Oct. 7, 1976, Pat. No. 4,090,300.

[51] Int. Cl.[2] ..... A41H 1/00; A41H 3/00; A41H 3/06

[52] U.S. Cl. ..... 112/266.1; 2/244; 112/439; 156/309; 156/331; 428/195

[58] Field of Search ..... 112/1, 78, 266, 439; 2/244, 246; 156/309, 331; 33/1 R, 17 R; 428/195, 355

[56] References Cited

U.S. PATENT DOCUMENTS

| | | | |
|---|---|---|---|
| 601,595 | 3/1898 | Smith | 2/244 |
| 699,019 | 4/1902 | Saunier | 112/266 |
| 889,614 | 6/1908 | Johnsen | 112/266 |
| 1,791,599 | 2/1931 | Moebus et al. | 112/439 |
| 3,816,211 | 6/1974 | Haigh | 112/439 X |

*Primary Examiner*—Louis Rimrodt
*Attorney, Agent, or Firm*—Robert D. Yeager

[57] ABSTRACT

A predetermined symmetrical pattern is sewn on a canvas by applying a flexible adhering sheet having printed thereon indications of a gridwork corresponding to the gridwork of the canvas. The flexible sheet is of substantially smaller area than the canvas and indicates STITCHES and paths to be followed. The edges of the flexible sheet gridwork are aligned with the canvas gridwork while they are joined together. The canvas is then sewn with a first set of stitches to establish paths and STITCHES illustrated by the paths on the flexible sheet. The flexible sheet is removed and a second set of stitches is sewn to complete the paths established by the first set of stitches.

7 Claims, 3 Drawing Figures

METHOD OF MARKING-OUT PATTERNS ON CLOTH FOR SEWING

This is a division of application Ser. No. 730,469, filed Oct. 10, 1976, now U.S. Pat. No. 4,090,300, 5/23/78.

BACKGROUND OF THE INVENTION

This invention relates to the sewing of fabrics and more particularly to sewing stitches on a canvas to form a design.

Embroidery is the art of sewing a decorative design by hand on a backing such as linen or canvas. When canvas is used, the art form is characterized as "needlepoint" or "canvas embroidery".

Needlepoint is distinguished from other forms of embroidery such as crewel embroidery in that in needlepoint the stitches are formed by passing yarn or thread through openings in the canvas which are in the array of a grid. As used herein needlpoint includes pulled thread embroidery.

"Canvas" as used herein corresponds to its meaning in needlepoint terminology and includes both "mono" or "uni" canvas and "Penelope" canvas whether constructed of fiber such as cotton or of plastic such as polypropylene. Mono or uni canvas is constructed of strands (in the case of fiber) or single filaments (in the case of plastic) which are crosshatched at right angles to form square openings of a uniform size. Penelope canvas is constructed of pairs of strands or filaments closely spaced which form the crosshatch. The size of the openings caused by the spacing of the strands and filaments is called the mesh. The mesh size is the count of openings per one linear inch of canvas. Typically needlepoint canvas ranges from 3 to 24 mesh.

"STITCH" in upper case letters as used herein refers to a particular species of stitches such as Gobelin Droit, Cross, Smyrna or the like. "Stitch" in lower case letters refers to the genus itself and includes all STITCHES.

An unlimited number of decorative fabrics may be formed using needlepoint techniques. These fabrics may vary in STITCH, yarn thickness, variations in STITCH throughout the workpiece, varying yarn colors, etc. Although many craftspersons create their own design while sewing a fabric or create a design on paper and reproduce it in the fabric, a primary source of designs is provided with packaged kits containing pattern, yarn and canvas or the patterns are sold separately.

There are essentially five variables in each design: (1) yarn thickness, (2) yarn color, (3) STITCH, (4) stitch placement, and (5) canvas grid size. The yarn thickness and canvas grid size can be readily indicated by simple directions on the pattern while stitch placement, STITCH, and yarn color (in multi-color designs) are more complicated to show.

In embroidery on linen or similar material, the pattern is printed on the fabric and the craftsperson merely sews over the pattern. This technique is not feasible in needlepointing designs based on geometric shapes dependent on variation in STITCHES. Further, since the canvas is substantially air space, printing of STITCH instructions are futile since most STITCHING is directionally oriented. Still further, fiber canvas is not perfectly true and when printed the design does not properly align with the gridwork thus resulting in an inoperative method of indicating STITCH location. Although polypropylene canvas is substantially geometrically true, it is not readily printed upon due to ink adhesion problems. Thus, designs are shown by separate charts indicating the location of STITCHES and yarn colors on the gridwork. In using these charts, the craftsperson must refer to the chart, stitch the canvas and then refer back to the chart before proceeding. In some instances, several stitches may be made without referral to the chart depending on the experience of the craftsperson and the simplicity of the design; nevertheless, constant cross-reference between the chart and the workpiece is necessary.

A large portion of the designs in needlepoint are symmetrical wherein a particular pattern is repeated in a single workpiece. Thus, halves, thirds, quarters, eighths, etc. of the workpiece are mirror images of their corresponding symmetrical segment or segments. These symmetrical designs may be rectangular or paths of a specific geometric form about the canvas. Another symmetrical design form in needlepoint is referred to as Bargello and Florentine; these are zig-zag or arcuate repeating patterns as opposed to the horizontal or vertical patterns previously described. The Bargello or Florentine stitches are sometimes referred to as "flame stitches" since they do not follow a horizontal or vertical path.

In accordance with the present invention, a method and apparatus for sewing symmetrical designs on a canvas is provided which may be easily used by the craftsperson.

SUMMARY OF THE INVENTION

A predetermined symmetrical pattern is sewn on a canvas by applyng within the sewing area a flexible adherent sheet having printed thereon indications of a gridwork corresponding to the canvas gridwork. The flexible sheet is of substantially smaller area than the canvas and indicates STITCHES and paths to be followed. The edges of the flexible sheet gridwork are aligned with the canvas gridwork while they are joined together. The canvas is then sewn with a first set of stitches to establish paths and STITCHES illustrated by the paths on the flexible sheet.

The flexible sheet is removed and a second set of stitches is sewn to complete the paths established by the first set of stitches.

The symmetrical pattern both printed on the flexible sheet and sewn on the canvas is comprised of vertical, horizontal, Bargello or Florentine arrays or paths of stitches and are preferably vertical and horizontal arrays or path stitches.

DETAILED DESCRIPTION OF THE INVENTION

The flexible sheet is constructed of a material which is at least as flexible as the canvas so that it conforms to flexing of the canvas during sewing without cracking or delamination from the canvas. Further, the flexible sheet must be capable of easing to provide for discrepancies between an oversized flexible sheet (in relation to the particular canvas to which it is applied) and the particular canvas. Also the flexible sheet must be capable of slitting to provide for discrepancies between an undersized flexible sheet (in relation to the particular canvas to which it is applied) and the particular canvas. The flexible sheet material can be rayon cloth, polyvinyl chloride sheet, polyethyleneterephthalate or a similar material which has the requisite flexibility and is capable of having clear printing applied thereto; the rayon cloth is now preferred. The adhesive which is used to adhere the flexible sheet to the canvas is a pressure sensitive removable adhesive. Typically such adhesives are comprised of a polymerized or copolymerized acrylic or vinyl polymer. In the preferred practice of the invention, the flexible sheet, which will have the pattern printed thereon, is coated on one side with the pressure sensitive adhesive. A release paper is applied to the adhesive and the sheet is printed on the clean opposite side. A preferred flexible pressure sensitive removable material is white rayon coated with a pressure sensitive adhesive sold under the tradename "mactac" by Morgan Adhesives Co.

Preferably the pressure sensitive adhesive leaves no residue on the canvas after removal of the flexible adhering sheet. Thus, the preferred adhesive has greater cohesion to itself and adhesion to the flexible sheet than its adhesion to the canvas.

The canvas useful in the practice of the inventon is between 3 to 14 mesh and more preferably 3 to 12 mesh. Above 14 mesh gridwork is so fine that alignment of the gridwork of the flexible adhering sheet and the gridwork of the canvas is extremely difficult. Further, the indication of the STITCHES on the flexible sheet must be so small that it can hardly be read by the craftsperson.

There are several different methods of indicating the stitches which are to occupy paths on the canvas. One method is to print the name of the STITCH on the flexible sheet in the path which the STITCH is to occupy. However, because of the large variety of STITCHES, known by various names, used in needlepoint, it is preferred to actually diagram the way in which the STITCH is made. This involves showing the configuration of the yarn as it will appear after it is passed through the openings in the canvas. For example, the gridwork corresponding to the gridwork of the canvas is printed on the flexible sheet as fine lines; thicker lines would illustrate the yarn configuration in a STITCH. For example, in the case of the Gobelin Droit, the line illustrating the yarn would originate at the center of a first crosshatch and terminate at the center of the crosshatch three crosshatches away from the first. This STITCH illustrating technique is well known to those skilled in the needlepoint art.

The indication of yarn color on the flexible sheet may be accomplished by either printing the color name in the appropriate path or by printing the STITCH designations in the desired colors.

Further aspects of the invention will become apparent with the following description of the drawings.

DETAILED DESCRIPTION OF THE DRAWINGS

Figure 1:
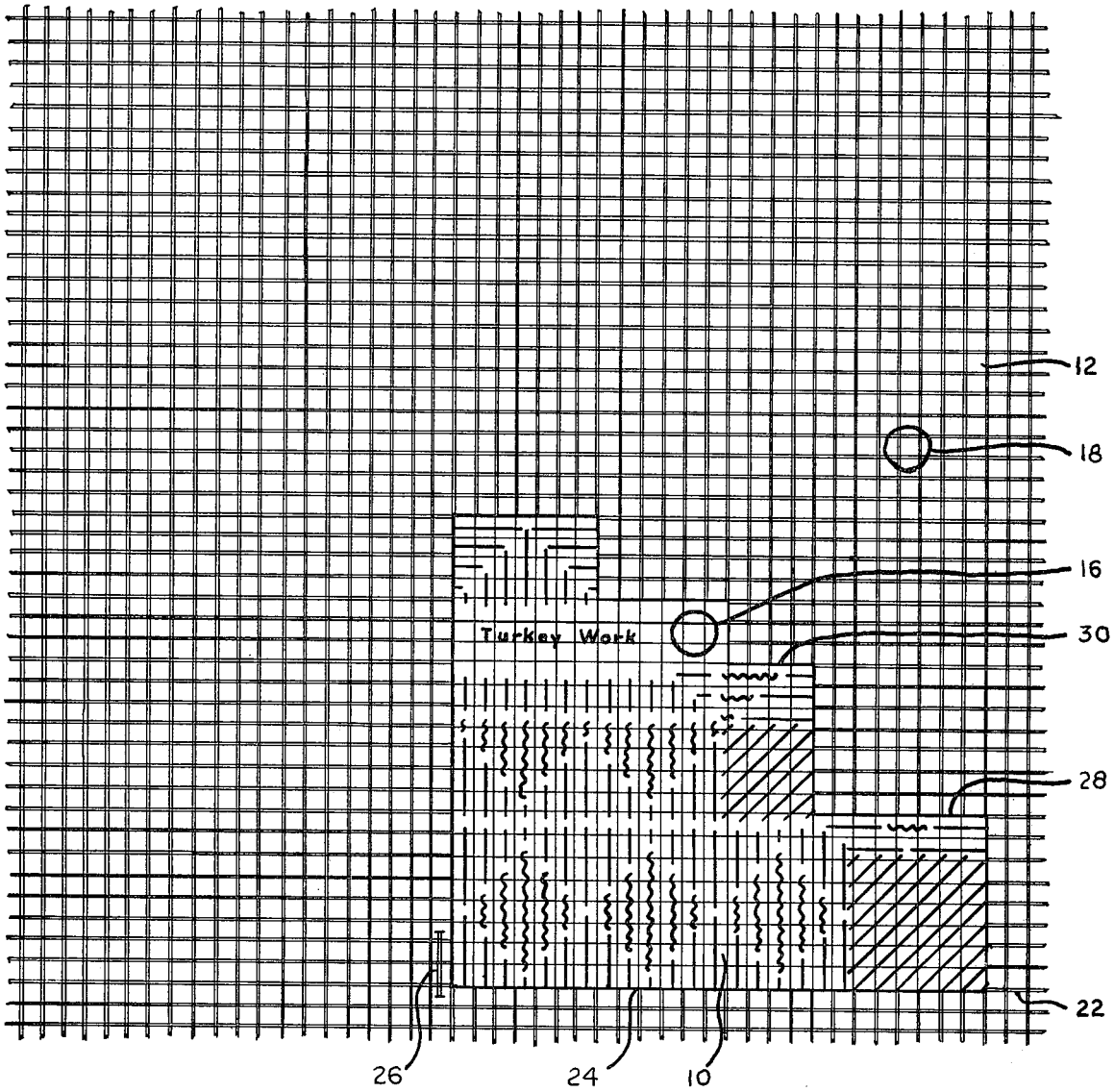
FIG. 1 is a plan view showing a flexible printed sheet applied to the canvas.
Figure 2:
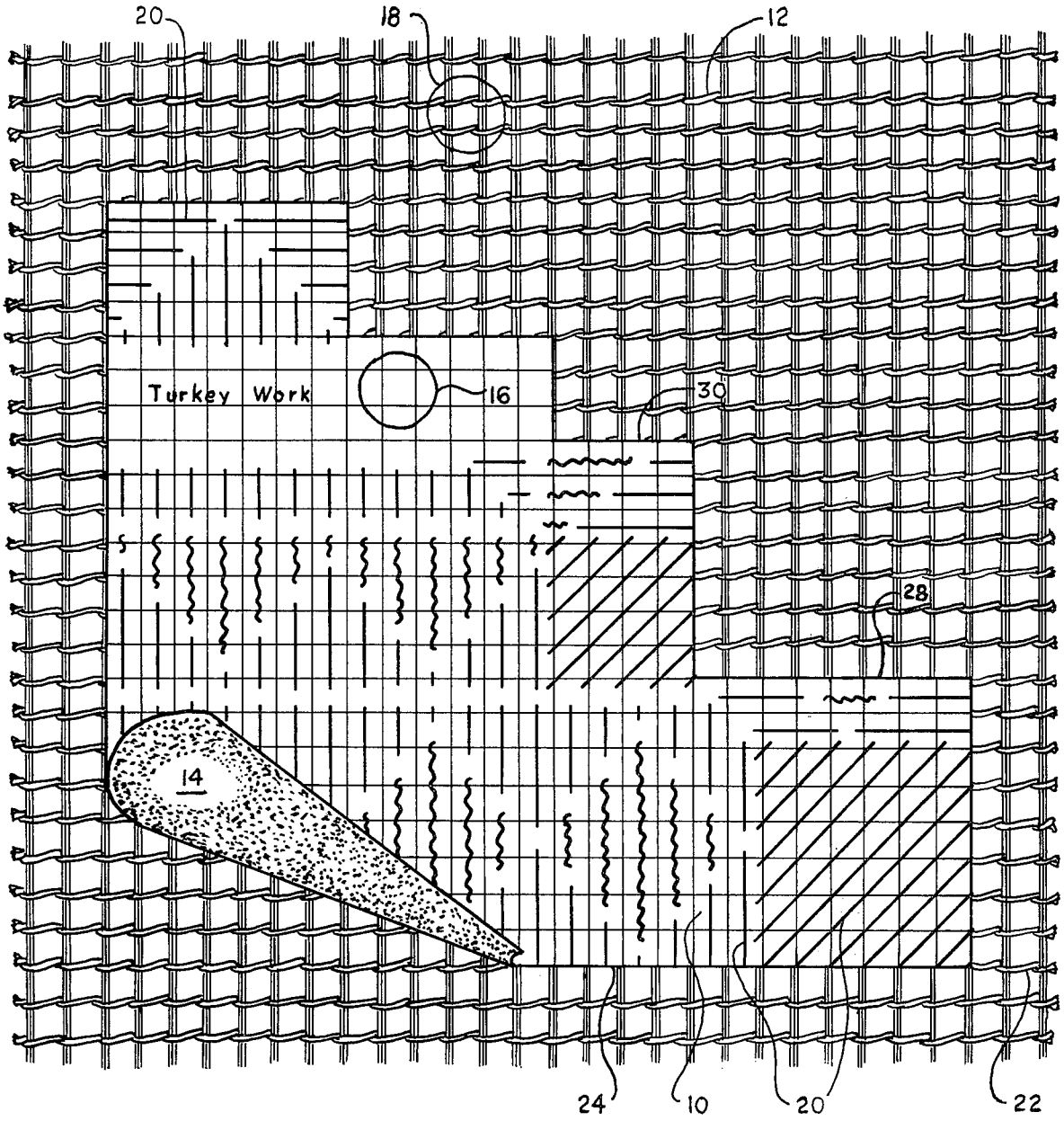
FIG. 2 is an exploded view of the flexible printed sheet, partially removed from the canvas.

Referring now to FIG. 1 and FIG. 2, a flexible sheet 10 is applied to a Penelope canvas 12 within the final stitching area. It will be noted that two threads around the perimeter of the canvas 12 will not be stitched in accordance with normal needlepoint practice in leaving some of the perimeter of the canvas unstitched.

Flexible sheet 10 is applied to canvas 12 by pressure sensitive adhesive 14. Flexible sheet 10 has printed thereon a gridwork 16 corresponding to the gridwork 18 of canvas 12. The lines designating gridwork 16 on flexible sheet 10 register at the edges with gridwork 18 of the canvas 12. Instructions for positioning and formation of STITCHES 20 are printed on flexible sheet 10.

In operation, a flexible material, in this case white rayon, is coated with a pressure sensitive adhesive 14. A release paper is applied to the adhesive and the rayon is printed with STITCHES 20 and with gridwork 16 which will correspond to gridwork 18 of canvas 12.

A proper sized canvas is matched with the flexible sheet and a sewing area is designated. The release paper is removed to free the flexible sheet 10 therefrom and the sheet 10 is applied to canvas 12 (in this embodiment of the invention) with the third horizontal thread 22 aligning with the edge 24 of sheet 10. The remainder of the edges of the flexible sheet 10 are aligned with the canvas gridwork 18. If necessary, the flexible sheet 10 is eased or cut as necessary to provide the proper alignment.

The craftsperson observes the paths of STITCHES 20 and begins to sew the appropriate stitches in the first available openings 26 to reproduce STITCHES 20 shown on flexible sheet 10. STITCHES are sewn substantially sequentially so that the perimeter of openings are occupied substantially sequentially. After the first path of STITCHES are sewn about the perimeter up to edge 28 of flexible sheet 10, a second path of STITCHES is sewn about the perimeter of canvas 12 occupying all spaces in the canvas 12 proximate to the STITCHES sewn in the first path up to edge 30 of flexible sheet 10. The process continues until the entire canvas is occupied by both stitches or by the flexible sheet 10 except when "turkey work" or a similar STITCH which is cumbersome to work around is employed in the final article and such stitching is left until all of the canvas is sewn with other stitches. After this first set of stitches is completed, the flexible sheet 10 is removed from canvas 12 and a second set of stitches is sewn which continues the paths established by the first set of stitches. Further the array of stitches sewn in the second set of stitches are identical to that shown on the flexible sheet 10.

In a second method, the paths of stitches are sewn just enough to duplicate the paths shown on the flexible sheet 10 forming a first set of stitches. The sheet 10 can then be removed and the sewing continued as previously described using the paths and stitches indicated by the first set of stitches.

Figure 3:
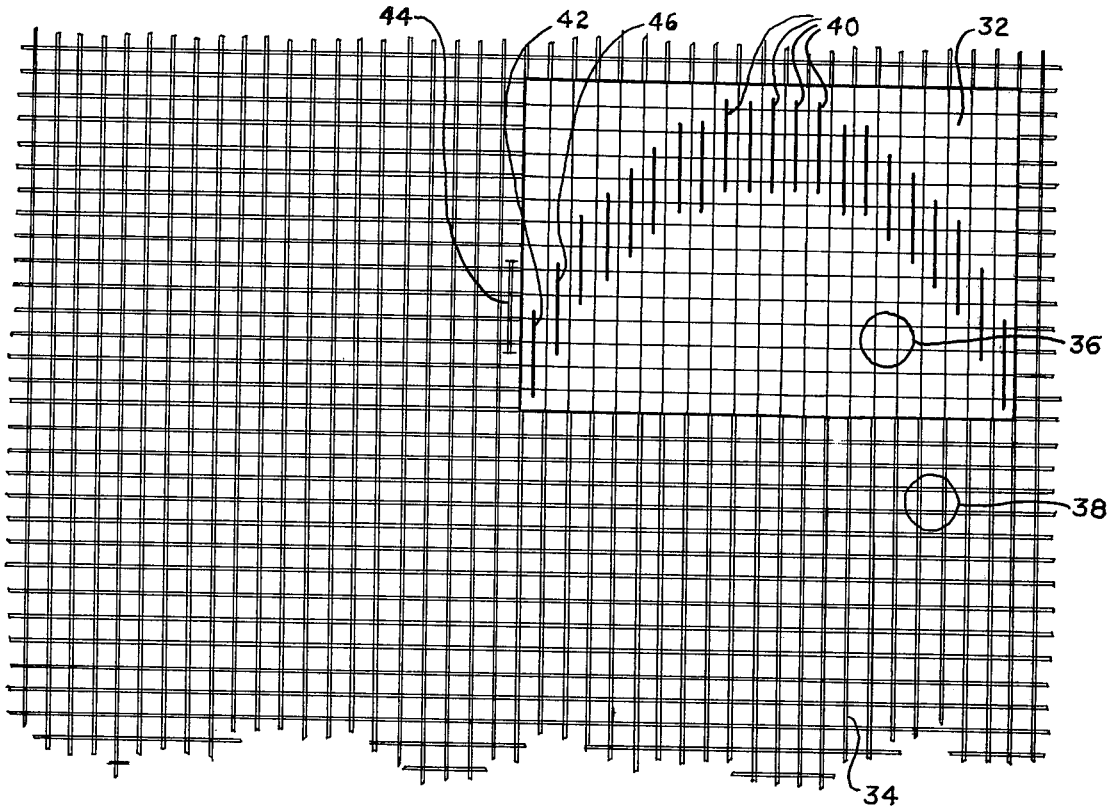
FIG. 3 is a plan view of a Bargello patterned flexible printed sheet applied to the canvas.

Referring now to FIG. 3, a flexible sheet 32 is applied as previously described to a canvas 34. As in FIGS. 1 and 2, the gridwork 36 of the flexible sheet aligns with the canvas gridwork 38. The STITCHES 40 are printed on flexible sheet 32 as previously described.

In operation, the flexible sheet 32 is applied to canvas 34 as described in the explanation of FIGS. 1 and 2.

In FIG. 3, STITCH 42 is the center stitch of the path and the first stitch to the sewn will be in openings 44 which will correspond to STITCH 46 on flexible sheet 32. The path of STITCHES is sewn in accordance with the path illustrated on flexible sheet 32. After the path is sewn forming the first set of stitches, the flexible sheet 32 is removed and the path of stitches is continued using the path set forth in the first set of STITCHES. After the second set of stitches is completed, the workpiece is sewn in the normal procedure for Bargello.

In accordance with the description herein of the invention and the drawings, it is evident that the technique of the invention can be utilized to provide methods of needlepointing different colors of yarn to provide color patterns using the same STITCH.

What is claimed is:

1. In the method of sewing a symmetrical pattern on a canvas wherein STITCHES are sewn through openings in the grid of the canvas along predetermined paths of side by side openings, and the side by side paths determine the selected pattern, the improvement comprising:

applying within the stitching area of the canvas a flexible adhering sheet having printed thereon indications of a gridwork corresponding to the gridwork of the canvas, the flexible sheet being of substantially smaller area than the canvas and indicating the STITCHES and paths to be followed along the canvas;

aligning the edges of the printed gridwork with the canvas gridwork while applying the flexible sheet to the canvas, the flexible sheet showing path segments and occupying path segments on the canvas;

sewing a first set of stitches to establish paths and STITCHES illustrated by the paths on the printed flexible sheet;

removing the flexible sheet and, sewing a second set of stitches to complete the paths established by the first set of stitches.

2. The method of claim 1 wherein said first set of stitches complete the paths up to the paths illustrated on the flexible sheet.

3. The method of claim 1 wherein the canvas is 3 to 14 mesh.

4. The method of claim 3 wherein the canvas is 3 to 12 mesh.

5. The method of claim 1 wherein the flexible adhering sheet is white rayon backed with a pressure sensitive adhesive.

6. The method of claim 1 wherein the paths of STITCHES are vertical and horizontal.

7. The method of claim 1 wherein the paths of STITCHES are zig-zagged.

* * * * *

UNITED STATES PATENT AND TRADEMARK OFFICE

CERTIFICATE OF CORRECTION

PATENT NO. : 4,154,181

DATED : May 15, 1979

INVENTOR(S) : Josephine V. Massucci and Rosemary Anne Parlak

It is certified that error appears in the above-identified patent and that said Letters Patent are hereby corrected as shown below:

Column 1, line 6, "Oct. 10, 1976" should read --Oct. 7, 1976--.

Signed and Sealed this

*Thirteenth* Day of *January 1981*

[SEAL]

*Attest:*

SIDNEY A. DIAMOND

*Attesting Officer*

*Commissioner of Patents and Trademarks*